US005645181A

United States Patent [19]

Ichiba et al.

[11] Patent Number: 5,645,181

[45] Date of Patent: Jul. 8, 1997

[54] METHOD FOR DETECTING A CRANE HOOK LIFTING DISTANCE

[75] Inventors: Akinori Ichiba, Satte; Yukio Tsutsumi, Saitama, both of Japan

[73] Assignee: Kato Works Co., Ltd., Tokyo, Japan

[21] Appl. No.: 264,418

[22] Filed: Jun. 23, 1994

Related U.S. Application Data

[63] Continuation of Ser. No. 834,331, filed as PCT/JP90/00784, Jun. 15, 1990 published as WO91/19665, Dec. 26, 1991, abandoned.

[51] Int. Cl.[6] ..... B66C 13/08

[52] U.S. Cl. ..... 212/281

[58] Field of Search ..... 212/276–284, 212/286, 230–232

[56] References Cited

U.S. PATENT DOCUMENTS

| | | | |
|---|---|---|---|
| 3,517,830 | 6/1970 | Virkkala | 212/146 |
| 3,685,668 | 8/1972 | Suverkrop | 212/256 |
| 4,717,029 | 1/1988 | Yasunobu et al. | 212/147 |
| 4,804,095 | 2/1989 | Rohr et al. | 212/152 |
| 5,127,533 | 7/1992 | Virkkunen | 212/146 |

FOREIGN PATENT DOCUMENTS

| | | | |
|---|---|---|---|
| 1205161 | 5/1986 | Canada | 212/149 |
| 2155446 | 5/1973 | Germany | 212/256 |
| 54-30754 | 9/1979 | Japan . | |
| 140350 | 10/1979 | Japan | 212/149 |
| 75393 | 6/1981 | Japan . | |
| 149995 | 11/1981 | Japan . | |
| 56-47117 | 11/1981 | Japan . | |
| 58-23883 | 2/1983 | Japan . | |
| 74496 | 5/1983 | Japan . | |
| 53338 | 3/1984 | Japan . | |
| 60-107710 | 7/1985 | Japan . | |
| 119585 | 7/1986 | Japan . | |
| 27896 | 7/1986 | Japan . | |
| 62-205993 | 9/1987 | Japan . | |
| 63-178291 | 11/1988 | Japan . | |
| 992404 | 2/1983 | Russian Federation | 212/149 |
| 1104098 | 7/1984 | Russian Federation | 212/149 |
| 1527134 | 12/1989 | Russian Federation | 212/146 |

OTHER PUBLICATIONS

Liebherr Operating Instruction Manual, Germany 1970.

*Primary Examiner*—Karen B. Merritt
*Assistant Examiner*—R. B. Johnson
*Attorney, Agent, or Firm*—Fish & Richardson P.C.

[57] ABSTRACT

Rope extension is detected as a rope shift distance at predetermined time intervals. A rope extension amount is obtained as the accumulated value of the shift distances. The rope shift accumulated value is automatically reset to 0 when a hook structure reaches an overhoist position to renew the reference position of the rope extension amount and to correct any measurement errors of the rope extension amount. From this rope extension amount, a hanging length of the hook structure from a boom or jib top is obtained and used to calculate a hook lifting distance. The calculated hook lifting distance, or hook structure position, is displayed on a display screen relative to a fixed index or pattern. An operator can monitor the state of the hook structure from the display.

3 Claims, 11 Drawing Sheets

OVERHOIST POSITION DISTANCE DISPLAY MODE

OVERGROUND DISTANCE (HOOK LIFTING DISTANCE) DISPLAY MODE

METHOD FOR DETECTING A CRANE HOOK LIFTING DISTANCE

This is a continuation application of U.S. Ser. No. 07/834,331, filed as PCT/JP90/00784, on Jun. 14, 1990 published as WO91/1966, on Dec. 26, 1991 now abandoned.

FIELD OF THE INVENTION

The present invention relates to an apparatus for calculating and displaying a crane hook lifting distance.

BACKGROUND OF THE INVENTION

A crane safety apparatus has been proposed (in Japanese Patent Publication No. 56-47117) in which various operation parameters (such as boom length, boom angle, outrigger extension, and jibbing) of a crane are detected by sensors, a digital memory storing rated loads for various operation states determined by the specification of the crane is accessed to retrieve the rated load specific to the detected operation parameters, the retrieved rated load is compared with the actual load, and a warning is issued when the actual load reaches a value near the rated load or the crane is automatically stopped when the actual load reaches the rated load.

A conventional crane safety apparatus does not have a function of correctly indicating a hook lifting distance. The hook lifting distance is known from the present state of the hook structure. However, there is no practical method of correctly knowing the length of a hook structure hung from the boom or jib top by the released rope. Furthermore, an apparatus has not been proposed which schematically displays a hook structure on a display within a target or operation range fixedly set by an operator, and allows the operator to monitor the hoisting and lowering operation of the hook structure.

SUMMARY OF THE INVENTION

In the method of calculating a hook lifting distance according to the present invention, a rope extension is detected as a rope shift distance at a predetermined time interval, and the accumulated value of rope shift distance is used as a rope extension amount. In accordance with the accumulated value of the rope shift distances, a hanging length of the hook structure is obtained. In response to a detection that the hook structure is at the maximum hook lifting position, the accumulated value of the rope shift distances is reset to renew the reference position of the rope extension amount. According to the method of the present invention, the reference position is automatically renewed so that a correct hanging length of the hook structure can be obtained and a correct hook lifting distance can be calculated from the obtained hanging length.

According to one aspect of the present invention, an apparatus is provided for displaying the hook lifting distance or hook structure position calculated by the above method, together with an operation range limit pattern, on a display screen. According to another aspect of the present invention, a crane operator places the hook structure on an actual target position and pushes a key. Then, the target position is set to the reference point (e.g., 0) fixedly displayed on the screen. The actual distance between the target and hook structure is displayed on the screen in correspondence with the distance on the screen between the schematic hook structure graphic image and reference point.

DETAILED DESCRIPTION

Figure 1A:
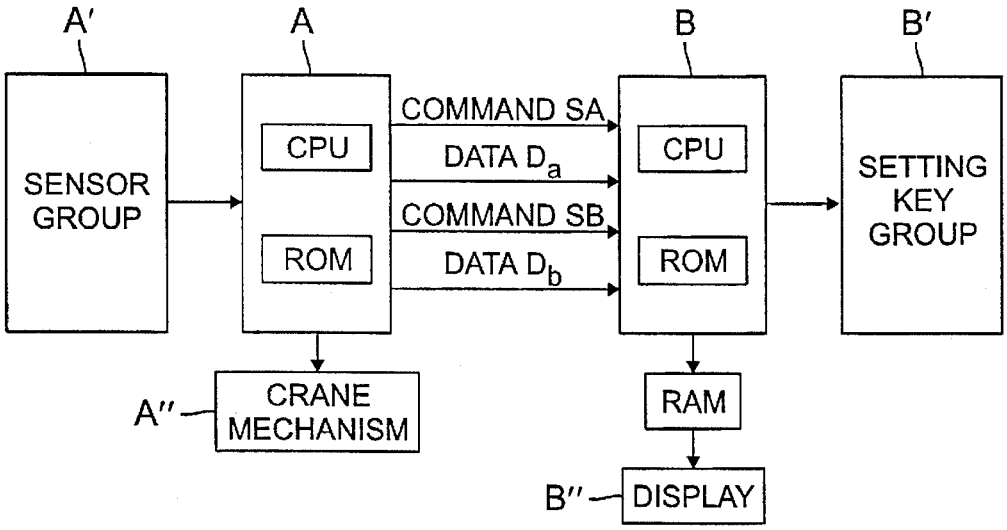
FIG. 1A is a block diagram showing the fundamental structure of the apparatus according to the present invention.

The fundamental structure of a crane safety apparatus according to the present invention is shown in FIG. 1A. The apparatus is constructed of a main unit A and a display unit B. During the operation of the apparatus, a main unit CPU and a display unit CPU always exchange commands and data.

When power is turned on, first a crane operation state (such as the number of outrigger stages, and the number of jib stages) is set at the display unit. An operator selects an operation state setting mode from a plurality of display modes displayed on a display B", by manipulating a predetermined key in a setting key group. The display unit has a memory which stores the operation state setting mode display as graphics data. The display CPU reads the display data in accordance with a display control program in ROM, and writes the data in a video RAM to display a display mode graphic image on the display B". Data such as the number of outrigger stages set by the operator using a setting key is fetched by the display unit CPU. The display unit CPU modifies the display mode graphic image in accordance with the setting data, and sends the setting data to the main unit A as data $D_B$, to thereafter complete the settings for the operation state mode. The operator then selects a monitor mode necessary for the crane operation, and reads the display data from the memory to display it on the screen.

The main unit A receives the crane operation state setting data $D_B$ sent from the display unit B, and fetches from a sensor group A' operation parameter data (boom length l, boom angle θ, swing angle ϕ rope extension amount, jib offset angle, and outrigger status) representative of the state of the crane mechanism changing from time to time as the crane is operated. The operation parameter data is, directly or after processing by the main unit CPU, sent to the display unit B as data $D_A$. In accordance with the data $D_A$, the display unit B modifies the display data on the display B" from time to time so that the present operation state of the crane can be monitored as a schematic graphic image.

Figure 1B:
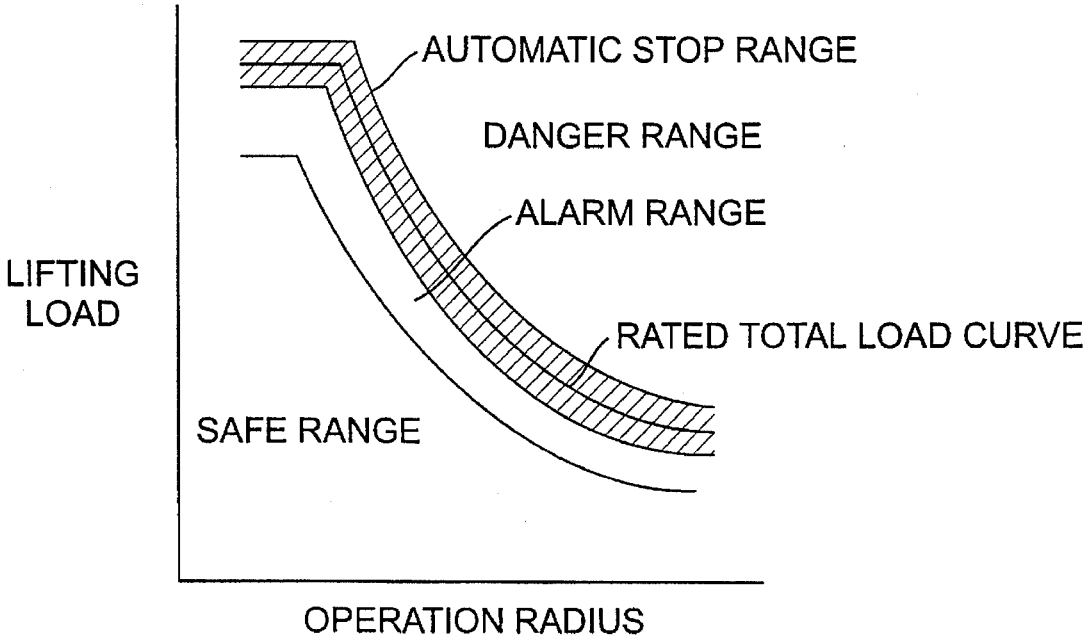
FIG. 1B is a graph showing an example of rated total load data curves whose data is stored in the apparatus of the present invention.

The main unit A stores data determined by the specification of the crane. Typical data is maximum rated loads at various crane operation states. For example, FIG. 1B shows rated load data curves under the operation state settings of a middle outrigger (5.9 m), extension (side), and no jib, with a boom length of 8.9 m. Rated total load curves of the crane are determined for each of various operation state settings and boom lengths. A great amount of such data is stored in ROM of the main unit A.

In accordance with the crane operation state setting data $D_B$ from the display unit B and the operation state parameter data from the sensor group A' of the crane as it changes from time to time, the main unit A accesses the maximum rated load data stored in ROM corresponding to the crane operation state at that time. The maximum rated load data obtained or processed is compared with an actual load. If the present crane operation state is within a danger range, the main unit sends a signal for controlling the crane mechanism A" so that a warning is issued and/or the crane is automatically stopped.

The ROM memory of the display unit B stores a plurality of display data for a plurality of display modes. A desired display mode is selected from a plurality of display modes, which includes a hook lifting display mode, by using a setting key. An operator can set the operation state and monitor the crane operation while referring to the display mode graphic image on the screen including the above-described and conventionally used automatic crane safety monitor mode graphic image.

The main unit A and display unit B run on their own programs. Transfer of commands and data between the main unit A and display unit B is carried out by an interrupt process.

An Embodiment of the Apparatus

Figure 2:
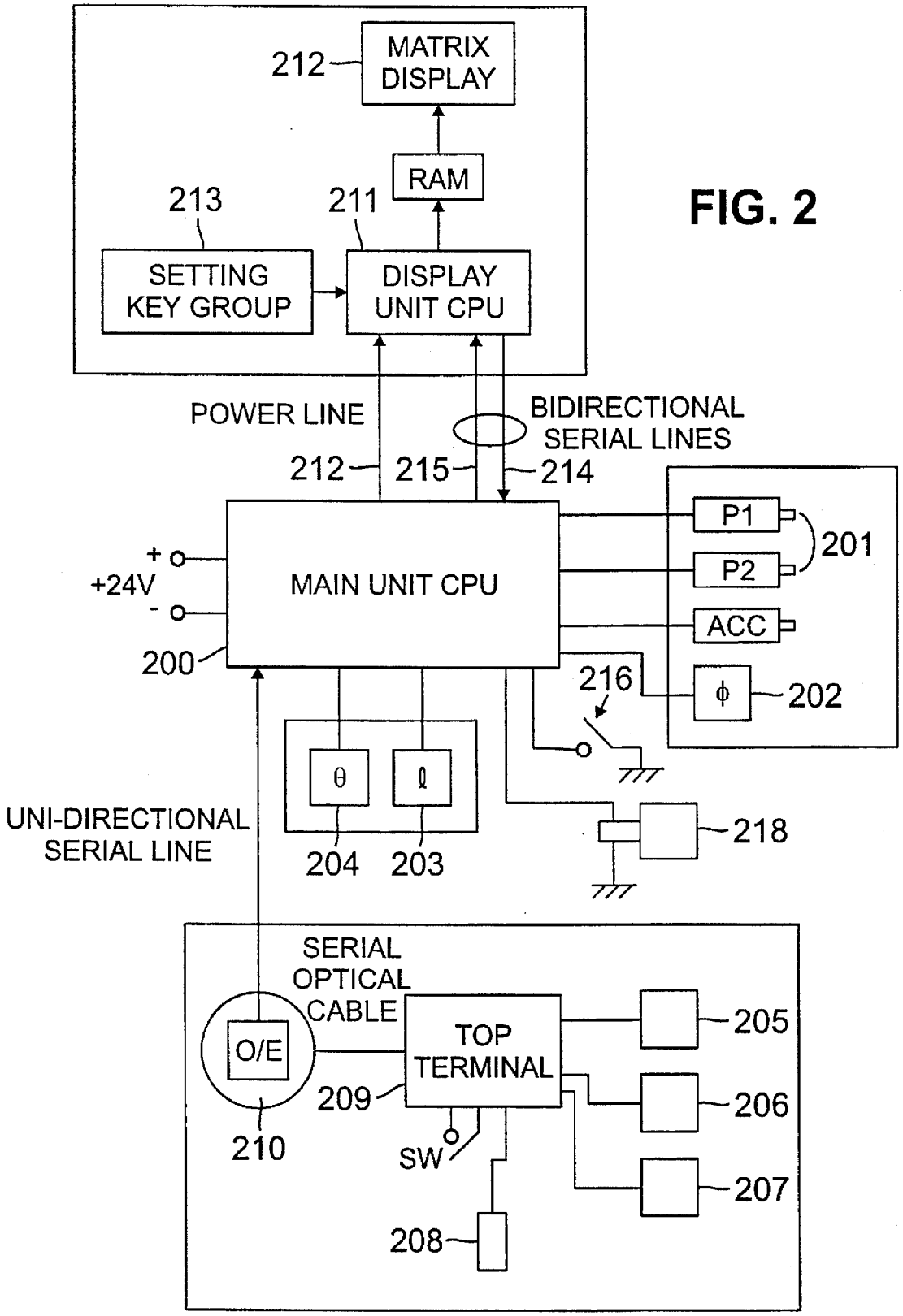
FIG. 2 is a block diagram showing a particular structure of the apparatus of the present invention.

Referring to FIG. 2, the main unit CPU 200 is inputted with actual load data from a pressure sensor 201, and other crane operator parameter data from a swing angle sensor 202, boom length sensor 203, boom angle sensor 204, boom overground top angle sensor 205, jib overground angle sensor 206, wire rope extension amount sensor 207, and pressure sensor 208, respectively, mounted on various positions of the crane mechanism. The data from the sensors 205 to 208 at the boom top is collected at a top terminal 209, and sent to a cord reel 210 at the boom bottom via optical fibers. The data is then converted into electric signals which are sent to the main unit CPU 200. The display unit CPU 211 is powered by the main unit CPU 200 via line 217. Commands and data are transferred via bi-directional serial lines 214 and 215 between the main unit CPU and display unit CPU. A display 212 is a matrix type, dynamically driven liquid crystal display (LCD). The LCD screen is easy to read in strong light, and thus is preferable over CRT, LED, and plasma displays because a crane is generally used outdoors and exposed to strong light. The LCD 212 is back-lighted at night. The setting key switch group 213 has a plurality of touch keys corresponding to a plurality of setting items. Signals for controlling the crane mechanism are outputted to plungers 218, electromagnetic valves and the like.

Figure 3:
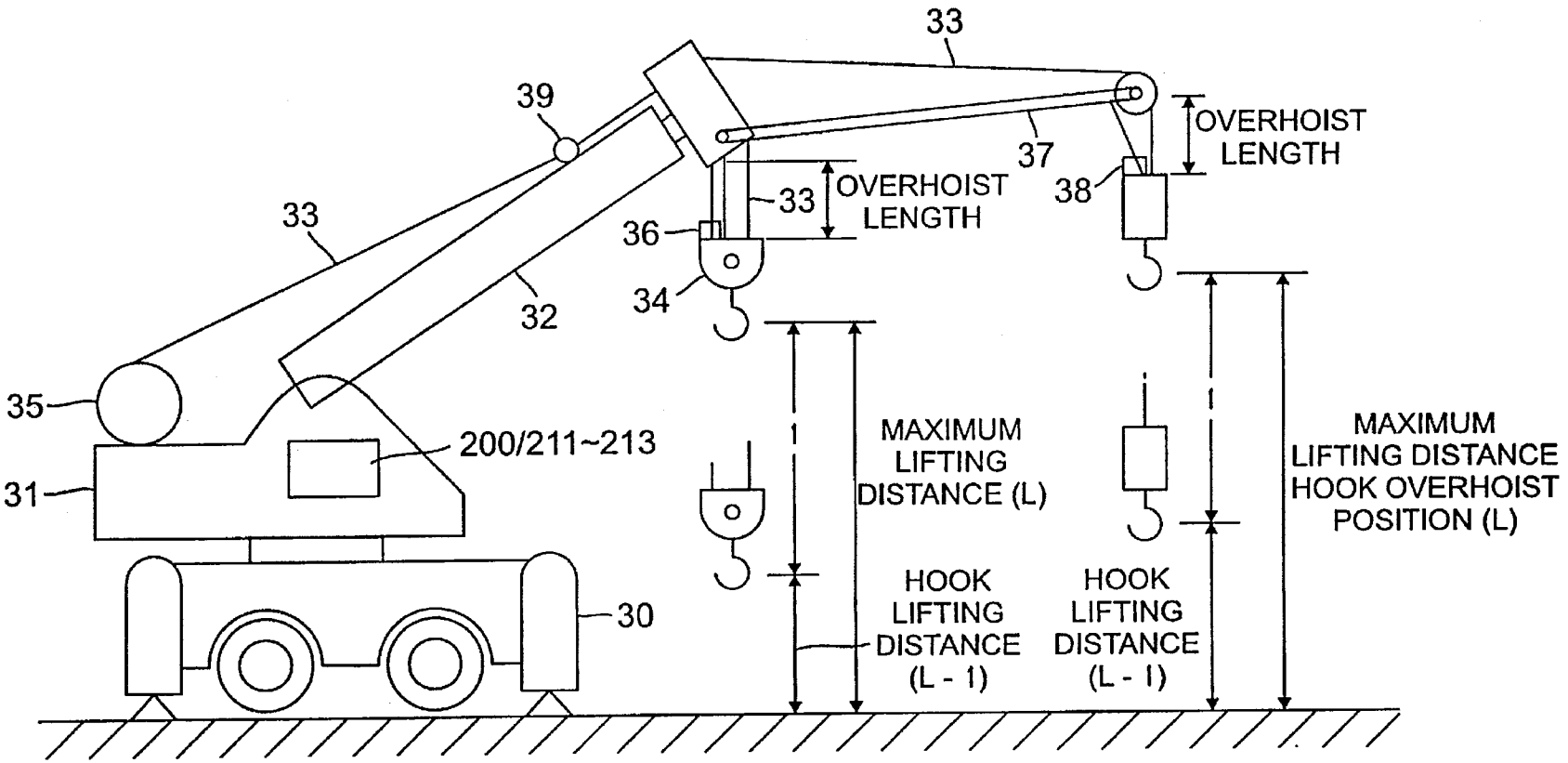
FIG. 3 is a diagram showing the crane mechanism and hook lifting distance.

An embodiment of the hook lifting distance displaying apparatus of the present invention utilizes one display mode of the above-described crane safety apparatus. The constitution of the present invention will further be described with reference to FIG. 3. A crane main frame 31 is supported by a fixedly mounted outrigger. Mounted within an operation cabinet of the crane main frame 31 are the main unit CPU 200, display unit CPU 211, display 212, and setting switch key group 213. The sensors are mounted on the crane mechanism at predetermined positions. A hook structure 34 is hung by a wire rope 33 from the top of a boom 32. The hook structure 34 is hoisted or lowered when the rope 33 is wound about or released from a winch 35. In FIG. 3, a jib 37 is additionally mounted. An overhoist sensor 36 (or 38) detects that the hook structure 34 was hoisted to a position lower than the top of the boom by a predetermined distance (overhoist length), and causes the winch-hoisting to automatically stop in order to prevent collision of the hook structure against the boom top. The predetermined distance from the boom top to the hook structure is called an overhoist length which has a value specific to the crane mechanism. The overground height of the hook structure at the overhoist length is the maximum lifting distance (L). Thus, the hook lifting distance is given by the following equation:

Hook lifting distance = maximum lifting distance − (rope extension amount − rope extension amount caused by a boom length shift − rope extension amount caused by a jib offset angle shift)/number of ropes on the hook As described above, the maximum lifting distance (L) is the length between the hook position (at the overhoist length below the boom or jib top which is a predetermined distance) and ground. This maximum lifting distance is calculated by the main unit CPU 200 shown in FIG. 2 in accordance with the setting state of the boom and jib measured with the various sensors.

In order to obtain the hook lifting distance at a specific time, it is necessary to calculate the length (l) of the rope hanging down from the boom or jib top. This length (l) is calculated by utilizing the terms within the parentheses of the above equation, and these terms are influenced by the state of the boom and jib and the rope extension amount. In the embodiment shown in FIG. 3, a pulse type rope extension amount sensor 39 is mounted on the boom at the upper position thereof. Specifically, each time the rope moves a predetermined distance, the sensor 39 generates one pulse which is supplied to the main unit CPU 200. The main unit CPU 200 contains a software up/down counter to count pulses from the sensor. The up/down counter acts as an up counter when an operation lever is manipulated to cause the winch 35 to lower the hook structure, and acts as a down counter when the operation lever is manipulated to cause the winch 35 to hoist the hook structure. When the sensor 36 detects that the hook structure 34 is at the overhoist position, it outputs a signal in response to which the up/down counter is automatically reset to "0". The rope extension amount, i.e., the rope winding or releasing amount, is determined by using as a reference the state of the hook structure 34 when it is at the overhoist position.

Even if the winch 35 does not positively wind or release the rope and hence there is no rope extension, the rope length below the overhoist position will change with the boom length.

Figure 4:
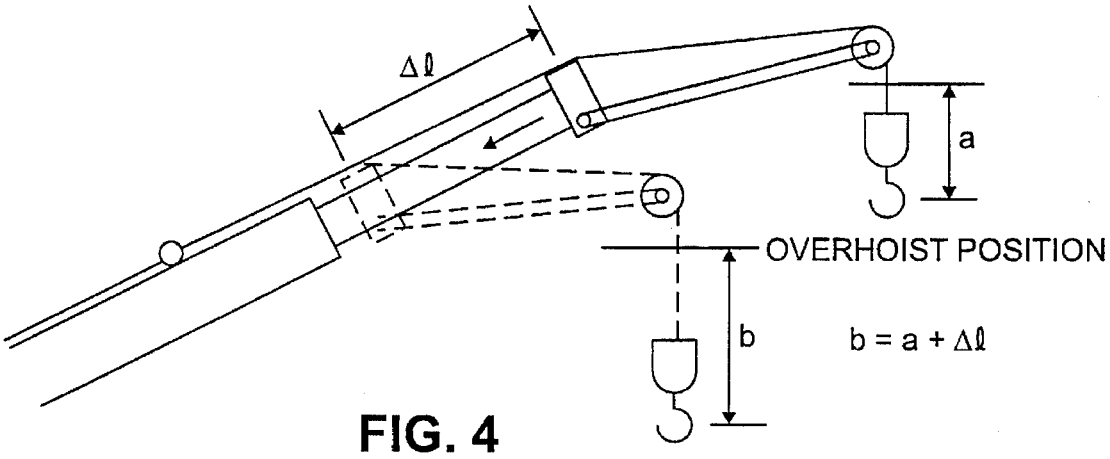
FIG. 4 is a diagram showing the change in rope length from the overhoist position as the boom length changes.

Referring to FIG. 4, as the boom length changes, the maximum lifting distance or the overhoist position will change and the rope length from the overhoist position to the hook structure changes from a to b, because the rope hangs down by the amount corresponding to the boom length change.

Figure 5:
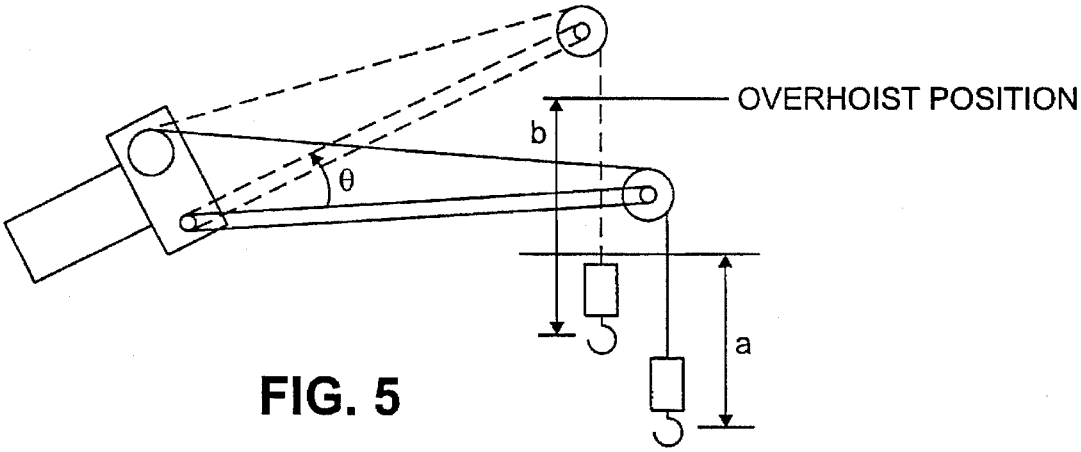
FIG. 5 is a diagram showing the change in rope length from the overhoist position as the jib offset angle changes.

Even if there is no rope extension, if the jib offset angle θ changes as shown in FIG. 5, the rope length below the overhoist position will change.

As shown in FIG. 3, one or more ropes may be extended from the boom or jib top and be connected to the hook structure 34. The rope length from the overhoist position to the hook structure 34 can be calculated by dividing the rope length by the number of ropes.

Data from the various sensors 201 to 208 and setting switch key group 213, shown in FIG. 2, is supplied from the display unit CPU 211 to the main unit CPU 200 to calculate the hook lifting distance.

The amount of winding of the wire rope about, or of releasing it from, the winch is not given as an absolute value, but rather is given as a relative rope extension amount from the reference position by the wire rope sensor 207. This relative rope extension amount is supplied to the main unit CPU 200. In this embodiment, the overhoist position sensor 36 (or 38) detects when the hook structure is overhoist at a boom angle of 30° or more and stays above the overhoist position several seconds or more before setting the overhoist position. The overhoist position detection signal generated by sensor 36 (or 38) is transmitted to CPU 200. This overhoist position is used as the reference position for calculating the rope extension amount caused when the rope is wound up or released from the winch 35.

The overhoist position of the hook structure is used as the reference position because this position can be easily set under any conditions with less error. The reason why the boom angle is set to 30° or more is because it is preferable to determine the reference position at the running state (normally the boom angle is set to 30° or less) of the crane. The reference position is therefore set immediately after starting crane operation. The reason why the hook structure stays above the overhoist position for several seconds or more before setting the reference position is to exclude the case where the hook structure swings and contacts the overhoist sensor.

It is difficult in practice to correctly measure the rope extension amount because there is some play in the mechanical components. Therefore, even if an operator initially manually sets the reference position, after continuous crane operation the software register within CPU 200 may sometimes, for example, store "+3" instead of "0" as the rope extension amount. According to the present invention, when the hook structure returns to the reference position, the register is automatically reset to "0". Thus, the reference position is automatically renewed to eliminate accumulated errors. When an operator sets the hook structure at the overhoist position during crane operation, particularly immediately after starting crane operation (the hook structure setting of the crane is always set immediately after starting crane operation), the reference position for the rope extension amount is automatically updated to the correct position.

Hook Lifting Distance Display in Automatic Safety Monitor Mode

The crane safety apparatus uses the hook lifting distance calculated by CPU 200, in the following manner. The hook lifting distance calculated during a predetermined time period is supplied to the display unit CPU 211.

Figure 6:
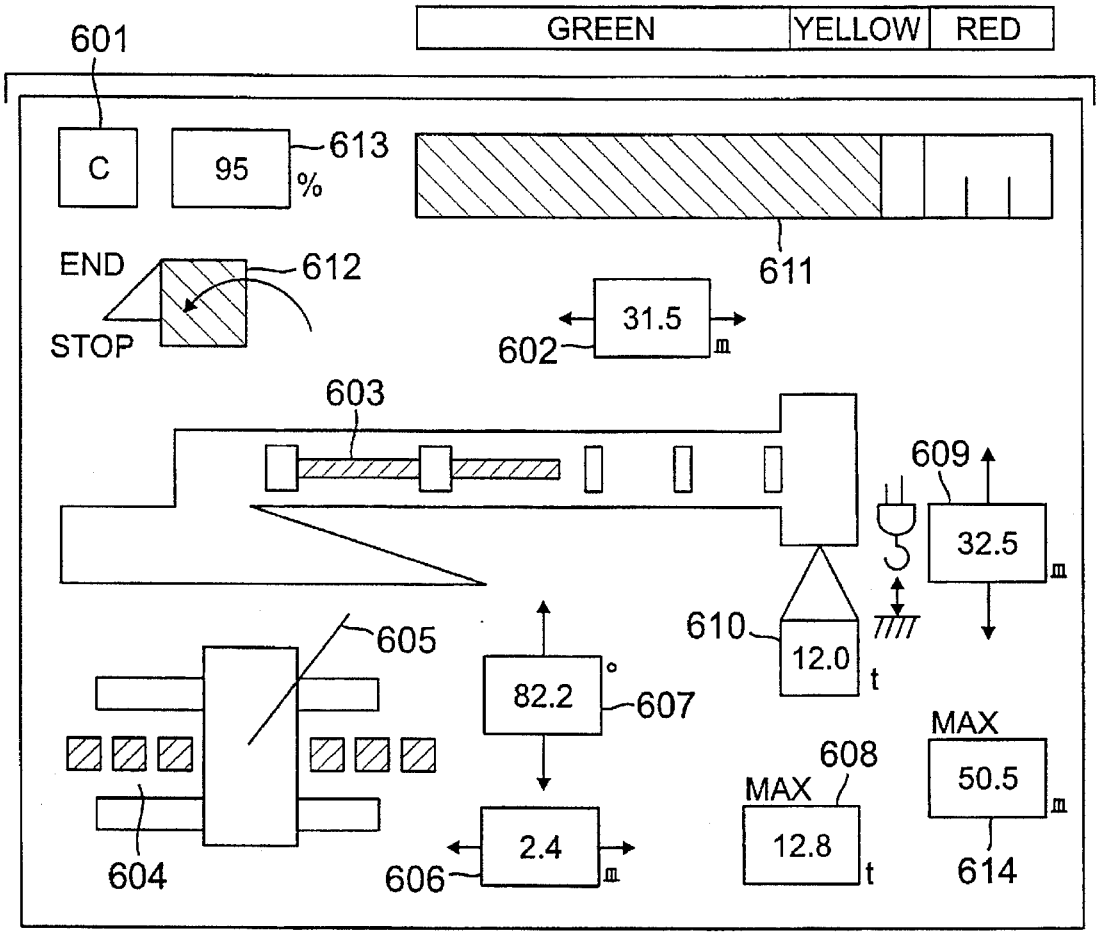
FIG. 6 is a diagram showing a graphical image in an automatic crane safety monitor mode of the apparatus of the present invention.

After an operator sets the operation state mode, the display unit CPU 211 automatically enters an automatic crane safety monitor mode and displays a graphic image such as that shown in FIG. 6. In accordance with the information supplied from the main unit CPU 200, the display unit CPU 211 displays the present crane operation state, including an outrigger setting 604, swing position 605, operation radius 606, boom angle 607, lifting load 610, hook lifting distance 609, boom length 602, and maximum lifting distance 614. The boom length is schematically shown as an expansion bar 603.

The present state of the crane is indicated by a bar graph 611 which also shows the safety limit of the crane. The numerical value representing the safety limit is indicated at 613. A limit (maximum) load for a given crane operation state is numerically shown at 608. When the crane operation state enters into the limit range (when the bar graph 611 expands to the yellow zone), a warning is issued. When the crane operation state enters the danger range (when the bar graph 611 expands to the red zone), the crane is automatically stopped. The present crane operation state is monitored by the main CPU 200 using data from the various sensors. The main unit CPU 200 accesses the memory to retrieve the maximum load for the crane operation state at that time and checks whether the actual load is equal to or less than the maximum load. The main unit CPU 200 outputs a signal to stop the crane operation mechanism when the actual load equals the maximum load of the crane operation at that time. During the automatic crane safety monitor mode, similar warning and automatic stop conditions are effected by the display unit CPU 211 not only when the actual load equals the maximum load but also when the actual operation range enters a limit operation range that is set by the operator.

One of the unique graphic images of this embodiment is the automatic stop cause indicator 612. When the crane is automatically stopped during the automatic crane safety monitor mode, it is sometimes difficult for an operator to quickly comprehend the cause of the automatic stop. It is difficult to comprehend the cause particularly when the crane falls over or breaks down due to an overload, or when the crane operation range is set in the monitor mode. Further, if the rope having a predetermined length is wound in during an idle state and is in excess of the rope length during crane operation, a reverse winding will occur which may not be apparent to an operator. In such a case, an automatic stop is carried out and its cause is illustratively shown at 612.

In this embodiment, when the hook lifting distance becomes 0 +/−1 m or −1 the maximum lifting distance indicator 614 flickers as a warning.

Hook Lifting Distance in Target Mode

Figure 7:
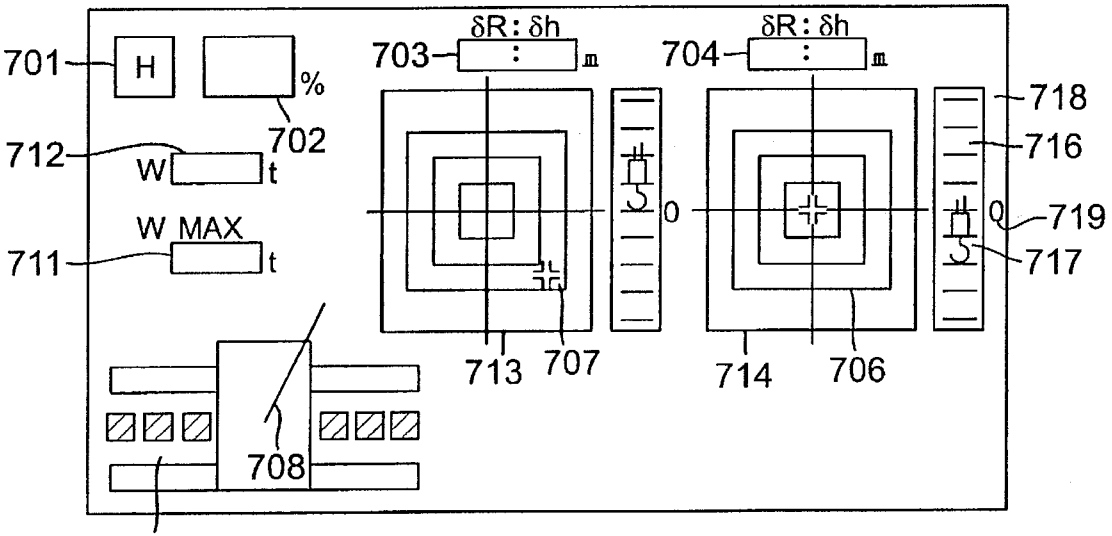
FIG. 7 is a diagram showing a graphical image in a target mode of the apparatus of the present invention.

Upon actuation of a mode selection key, the display unit CPU enters the target mode and displays a graphic image such as that shown in FIG. 7. The target mode is used when an operator sitting inside the crane cannot see a hanging load. Target index marks 705 and 706, indicated by solid lines in FIG. 7, are used for setting two target points on the horizontal plane. One side of the innermost target index mark corresponds to an actual distance of 15 cm in the radial direction, that of the next mark corresponds to 40 cm, and that of the outermost mark corresponds to 60 cm. The sides correspond respectively to +/−5°, +/−10°, and +/−15° in the circumferential direction. Indices 715 and 716 indicate the lifting distance of the hook structure in the vertical direction at the two target points in the horizontal plane. A mark 718 represents the overhoist position, a mark 719 represents the target position (0 point) in the vertical direction, and a mark 717 represents the actual position of the hook structure. A hanging load is placed at the target position in the vertical and horizontal directions by operating the crane, and then the setting key is actuated to set the target position as the first target. The target position is set as the 0 point of the coordinate system. The position of the hanging load in the horizontal plane is displayed on the target index mark display area as a distance from the 0 point. The target position of the hook structure in the vertical direction corresponds to the mark 719, and the actual position of the hook structure is indicated by the mark 717. After the target position is set, the operator knows the position of the hanging load relative to the target position without directly looking at the hanging load. Crane operation often includes moving a hanging load from the first point to the second point by swinging the boom. In this case, the target index marks 705 and 715 are used for setting the first point, and the target index marks 706 and 716 are used for setting the second point. On the display screen, the index marks 705 and 715, and the index marks 706 and 716 are used for displaying different and independent coordinate systems. The two sets of index marks 705 and 715, and 706 and 716 show the effective display area of the coordinate systems of the first and second points, and correspond to an actual size, for example, of 100 cm square. A hanging load within the effective area is represented by a ‡ mark. For a hanging load outside of the effective area the ‡ mark moves towards a broken line 713 as indicated at 707 so that the operator knows the direction of the hanging load. While referring to the mark displayed relative to the target index mark, the operator can carry out repetitive operations of moving the hanging load between the first and second points in the horizontal and vertical directions, even if the operator cannot visually confirm the actual position of the hanging load. The distances of the hanging load between the first and second points in the horizontal and vertical directions are displayed at the upper area of the display screen at 703 and 704. Displayed for the sake of convenience at the lower left of the display screen area are an outrigger setting 709 and a boom swing position 708. In addition, displayed for reference sake are a load weight 712 and a maximum load 711. Finally, reference numeral 701 represents a mode, and reference numeral 702 represents a numerical value of the degree of safety.

An actual hanging load position is calculated by the main unit CPU from the data of the various sensors and from crane setting data, and is given to the display unit CPU as hanging load position data and crane lifting distance data. When an operator designates a certain position as a target position within the target index marks 705 and 715 by actuating the touch keys, the display unit CPU sets the lifting position data at that time as the 0 point of the index marks 705 and 715.

Figure 7B:
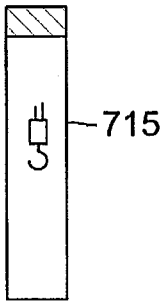
FIGS. 7A and 7B illustrate a hook lifting distance display mode and an overhoist position display mode, respectively, of a hook lifting distance indice of FIG. 7.
Figure 7A:
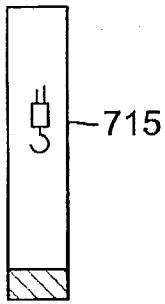

In addition to the mode of displaying the hook structure position relative to the target position (0 point), a hook lifting distance is displayed as index 715 and index 716 in FIG. 7. The index 715 or 716 can be displayed in a selected one of two modes as shown in FIGS. 7A and 7B.

Figure 8:
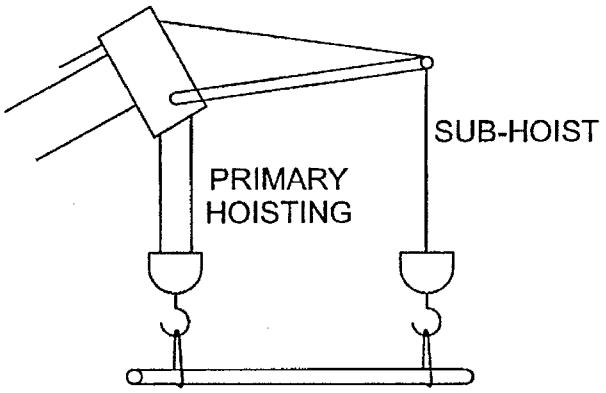
FIG. 8 shows the crane mechanism depicting a crane operation using a primary hoist and a sub-hoist.

In another display mode, the index 715 is used to display the primary hoisting hook structure position, and the index 716 is used to display the sub-hoisting hook structure position (the primary and sub-hoisting hook structure positions are shown in FIG. 8). The symbols representing the hook structure in the indices 715 and 716 display a difference between the primary hoisting and sub-hoisting hook structure positions. For example, if the primary hoisting hook is higher than the sub-hoisting hook by 1 m, then the symbol representing the primary hoisting hook is displayed higher than the middle position of the index. In this example, the hooks are brought to the same height by lowering the primary hoisting hook or by hoisting up the sub-hoisting hook.

Hook Lifting Distance Display in Operation Range Limit Mode

Figure 9:
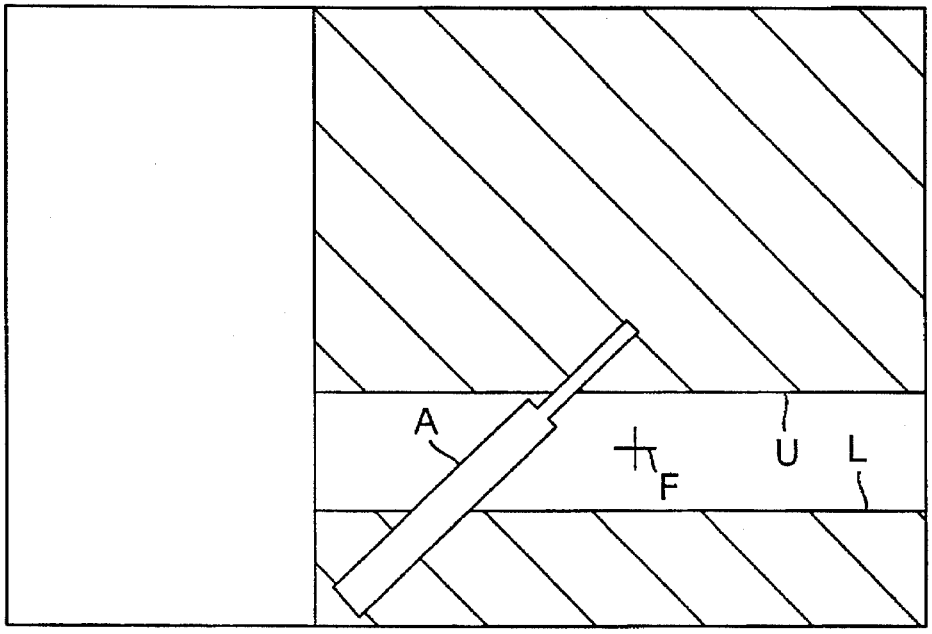
FIGS. 9 and 10 are diagrams showing graphical images in an operation range limit mode.
Figure 10:
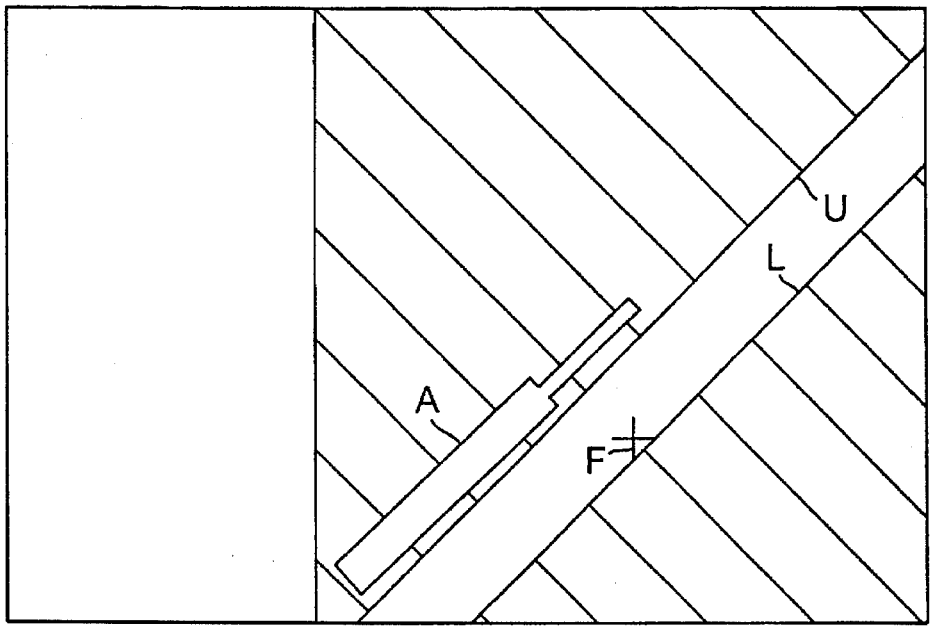

Apart from the tumbling over or breakage limits of the crane, in the operation range limit mode of this embodiment, the operation range of the hook structure is preset so that the hook structure and hanging load do not contact nearby buildings or the like. If the boom or rope extension exceeds the preset range, a warning is issued or the crane is automatically stopped. When the display unit CPU enters the operation range limit mode, graphic images such as those shown in FIGS. 9 and 10 are displayed. The boom and jib are illustrated at A on the display screen and the position of the hook structure is indicated at F. This graphical illustration changes as the crane moves. In setting the operation limit of the hook structure, an operator moves the hook structure with an actual lifting load to limit points (upper and lower limits). Under these conditions, the operator pushes a limit setting switch so that the upper and lower lines indicated at U and L are drawn on the display screen as shown in FIGS. 9 and 10. FIG. 9 illustrates the absolute upper and lower limit positions of the hook structure. FIG. 10 illustrates the distance limits of the hook structure from the overhoist position near the boom or jib top. As the boom angle changes, the limit lines U and L are also changed and displayed correspondingly. While monitoring such graphic illustrations, a crane operator manages the F mark so that it does not move outside of the limit range.

In setting the limit range, the hook structure is actually moved to the limit points and the setting key is actuated at that time. It is important to note that the range limit is not set by entering limit values determined by an operator, but by actually moving the hook structure to the limit points. This method is advantageous because the operation range can be set by actually moving the hook structure on site.

Operation sequence of Apparatus

The operation sequence of the apparatus according to this embodiment of the present invention is controlled by programs independently running on the main unit and display unit CPUs. The main unit CPU receives the operation parameters from the various sensors and the operation range setting data from the display unit CPU, calculates the actual load, operation range radius, limit load, maximum lifting distance, hook lifting distance, and the like, automatically stops the crane mechanism, and sends the data to the display unit CPU. The display unit CPU displays a graphic image of a selected mode in accordance with the data from the main unit CPU, modifies the graphic image in accordance with the data inputted from setting keys, and transmits the inputted setting data to the main unit CPU. The sequences of the main unit and display unit CPUs run independently from each other, while transferring commands and data upon occurrence of an interrupt.

Programs for sequence control of the main unit and display unit CPUs are stored in ROM. The display unit has a video RAM which stores display graphic data of a selected display mode. The contents of the graphic data are modified as the crane operation state changes. The graphic data in the video RAM is transferred to the display at intervals of 150 ms, for example, to update the graphic image.

Data $D_A$ and $D_B$ are transferred between the main unit and display unit by a start-stop synchronization of the data communication sequence. Each time data to be transmitted to the display unit is generated at the main unit, the main unit CPU receives a transmission request interrupt to transmit the data. The display unit then receives a reception request interrupt to receive the data. Data is transmitted from the display unit and received by the main unit in a similar manner.

Data from the various sensors representative of the crane operation state are received by the main unit CPU via an A/D converter. In response to a sensor data read request interrupt issued at a predetermined time, the main unit CPU reads the sensor data from the A/D converter.

A key input at the display unit is checked at a predetermined cycle to execute the process suitable for a depressed key.

A timer interrupt is received by the main unit and display unit CPUs to execute a process at a predetermined time interval.

The display unit CPU writes graphic data in the video RAM in accordance with the data received at the display unit to display a graphic image, and supplies the operation limit setting data and the like to the main unit.

The main unit CPU calculates a boom radius, lifting distance, actual load, and limit load in accordance with the data received at the main unit, compares them with the performance data defined by the crane specification, and outputs a control signal for automatically stopping the crane if necessary, and outputs other control signals.

(1) Main Unit Operation Sequence

Figure 11:
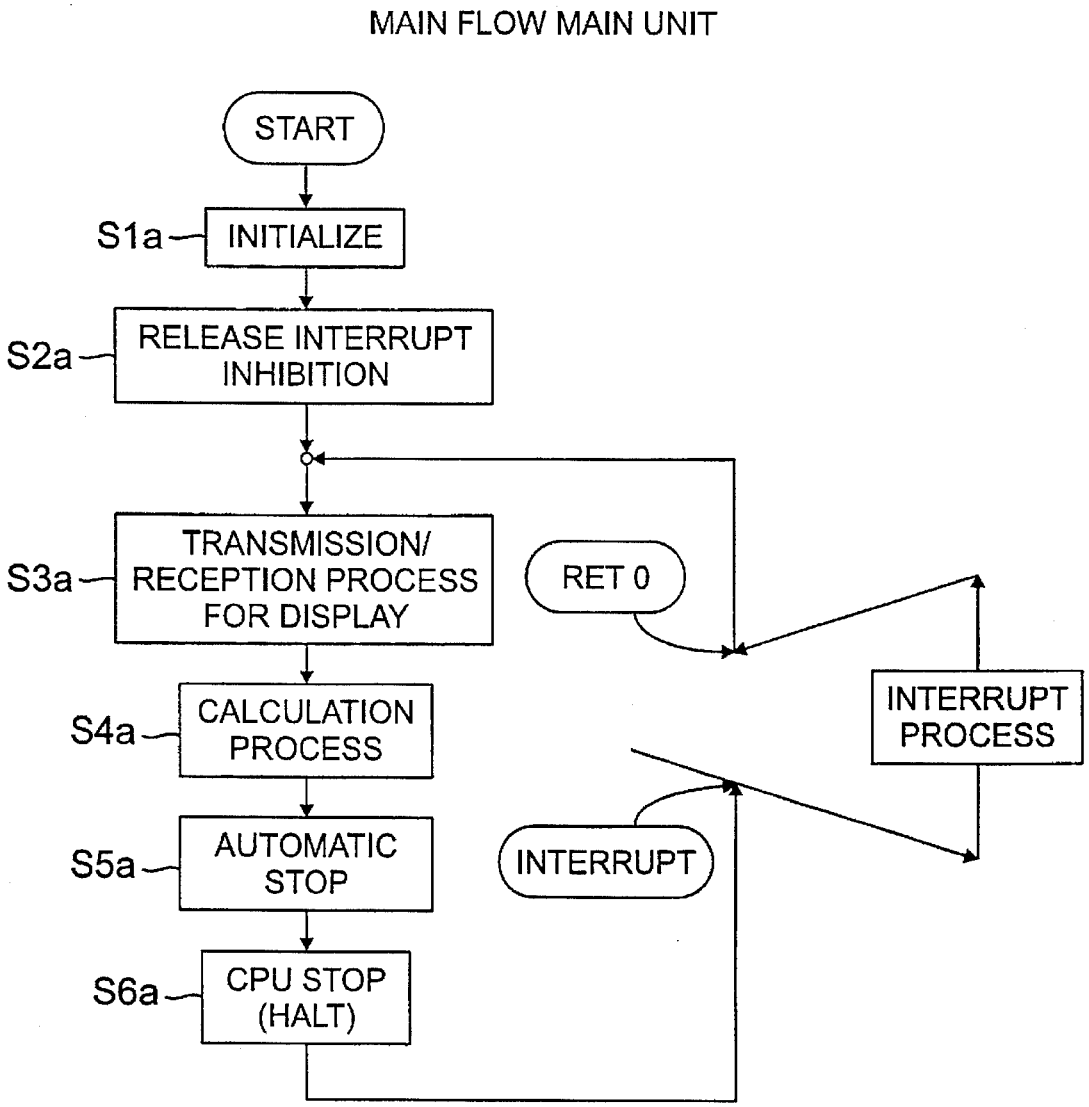
FIGS. 11 to 16 are flow charts showing the operation sequences of an apparatus according to the present invention.

Referring to FIG. 11, in response to powering or resetting the apparatus, the main unit performs the main flow sequence at steps $S_{1a}$ to $S_{6a}$. The first step $S_{1a}$ checks whether the apparatus is in a proper state and initializes the CPU settings for achieving the proper execution at the later steps. Prior to this initializing, an interrupt is inhibited, and after completion of the initializing, an interrupt inhibition is released at step $S_{2a}$. At step $S_{3a}$, it is checked whether data to be transmitted to the display or data received from the display is present. If such data is present, the data is subjected to transmission/reception. Data transmitted to the main unit is received upon execution of a hardware interrupt similar to the case of receiving data from the sensors.

At step $S_{4a}$, various calculation processes are executed for the received and processed data. Specifically, parameters representative of the crane operation state including an actual load, boom radius, maximum lifting distance, hook lifting distance, and the like are obtained from data such as boom length, boom angle, pressure, rope extension amount, and the like. A limit load is obtained from the parameters and a preset limit load data defined by the crane specification. At step $S_{5a}$, the safety degree of the crane operation is calculated from the results obtained at step $S_{4a}$, the crane operation state is compared with the operation limit value, and an automatic stop process is executed by generating a stop signal if the crane operation state is in the danger range or over the operation limit.

After the above sequence steps, the main unit CPU enters a stop (HALT) state at step $S_{6a}$. When a hardware interrupt request (IREQ) for receiving data is received from an external component, the main unit CPU in the stop state executes the interrupt process and thereafter returns to the loop start point. If there is no hardware interrupt, the main unit CPU remains at step $S_{6a}$. In FIG. 11, although a hardware interrupt is set between step $S_{6a}$ and the loop start point, this interrupt may be set at a desired point anywhere within the sequence at steps $S_{3a}$ to $S_{6a}$. In the main flow, data reception at the main unit and data transmission to the display unit are activated by an interrupt. After transmission/reception of new data, the data is processed and the automatic stop process is executed.

(2) Display Unit Operation Sequence

Figure 12:
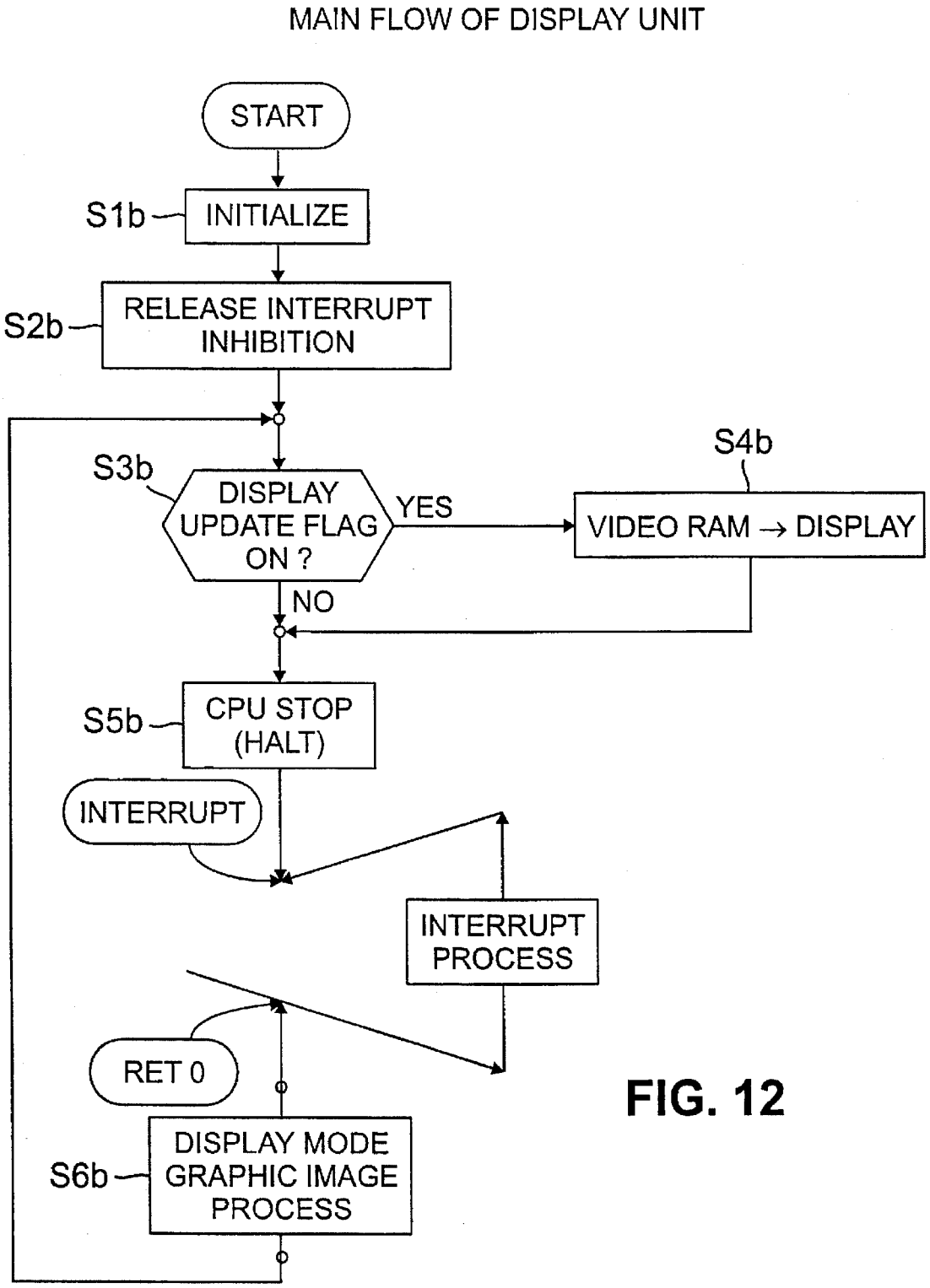

FIG. 12 shows the main flow of the display unit. The first step $S_{1b}$ initializes the display unit CPU settings for achieving the proper execution at the later steps. At step $S_{2b}$, an interrupt inhibition is released. The crane operation state display changes from time to time on the display in a certain display mode, and the graphic image for the crane operation state is first written into the video RAM. The graphic image data is read from the video RAM at predetermined time intervals, for example, 150 ms and displayed on the display. In this manner, the contents of the graphic image on the display are updated at intervals of 150 ms. In this embodiment, coordinate values of each line segment constituting an image are stored as the graphic image data. If a display update flag is being set at step $S_{3b}$, then at step $S_{4b}$ the graphic image data is transferred from the video RAM to the display to update the displayed image.

In response to powering or resetting the apparatus, the initial display data stored in the video RAM set at step $S_{1b}$ is displayed. Thereafter, the display CPU enters into a stop (HALT) state at step $S_{5b}$ and maintains it until a hardware interrupt is received.

A hardware interrupt to the display unit CPU includes a timer interrupt and a data transmission/reception interrupt relative to the main unit CPU. The display unit CPU transmits or receives the data for a given type of hardware interrupt. In the main flow after an interrupt, a process for a selected mode is executed at step $S_{6b}$. Specifically, a graphic image for the selected mode is written into the video RAM in accordance with new data. This process for a selected mode is always activated by a hardware interrupt. A hardware interrupt is also allowed during this graphic image processing, but it is not allowed during a short time period while a hardware interrupt is being processed. The updated graphic image in the video RAM is displayed on the display at steps $S_{3b}$ and $S_{4b}$.

(3) Calculation of Hook Lifting Distance

Figure 13:
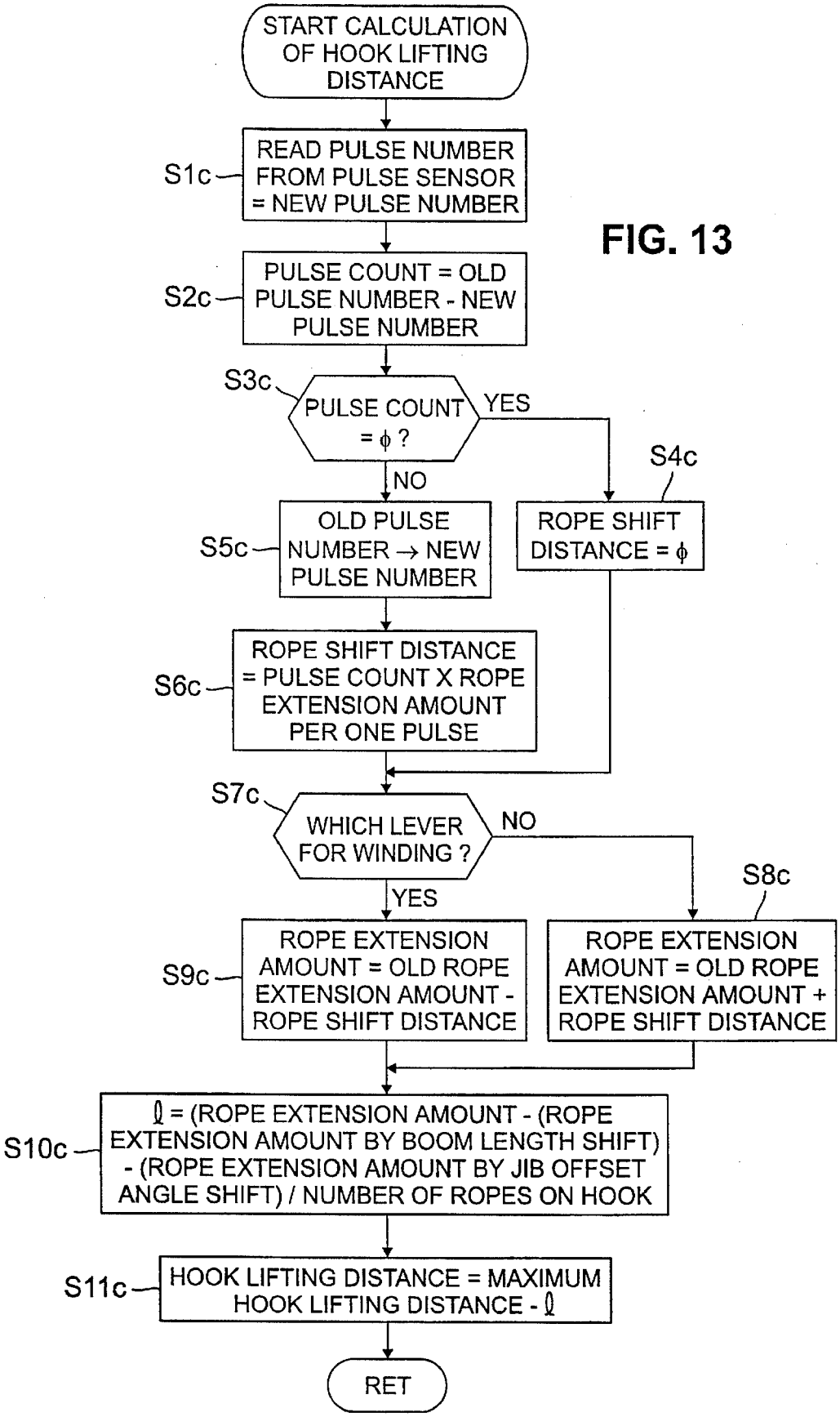

Calculation of a hook lifting distance by the main unit CPU 200 is carried out by the routine shown in FIG. 13 which is activated at a predetermined time interval. The pulse sensor generates a pulse each time the rope is extended by a predetermined amount. There is a counter buffer for counting these pulses. At step $S_{1c}$, the count in the counter buffer is read as a new pulse number. At step $S_{2c}$, the new pulse number is subtracted from an old pulse number read at the previous count time and stored in a software register. The resultant pulse count is the number of pulses generated during the period from the previous count time and the present count time as the rope is extended. If the resultant pulse count is 0 at step $S_{3c}$, it means that the rope was not extended during this period. Therefore, the rope shift distance is set to 0 at step $S_{4c}$. If the pulse count is not 0, at step $S_{5c}$ the new pulse number is replaced by the old pulse number stored in the software register. At step $S_{6c}$, the rope shift distance is calculated from the pulse count multiplied by the rope extension amount per one pulse. At step $S_{7c}$, it is checked to see if the winch lever is set up for winding or releasing. If not winding, at step $S_{8c}$ the present rope extension amount is obtained by adding this rope shift distance to an old rope extension amount calculated at the previous count time and stored in a software register. If winding, at step $S_{9c}$ the present rope extension amount is obtained by subtracting the rope shift distance from the old rope extension amount. This present rope extension amount replaces the old rope extension amount stored in the software register. At the next step $S_{10c}$, a boom length shift amount is obtained by subtracting the old boom length detected at the previous count time from the present boom length. At step $S_{10c}$, the rope extension amount corresponding to the boom length shift amount and the rope extension amount corresponding to the jib offset angle shift are subtracted from the rope extension amount obtained at step $S_{8c}$ or $S_{9c}$. The resultant rope extension amount is divided by the number of ropes on the hook structure to obtain l which represents the rope length hanging down from the overhoist position described above. Therefore, the hook lifting distance is obtained at step $S_{11c}$ by subtracting l from the maximum lifting distance calculated from the crane operation state.

Figure 14:
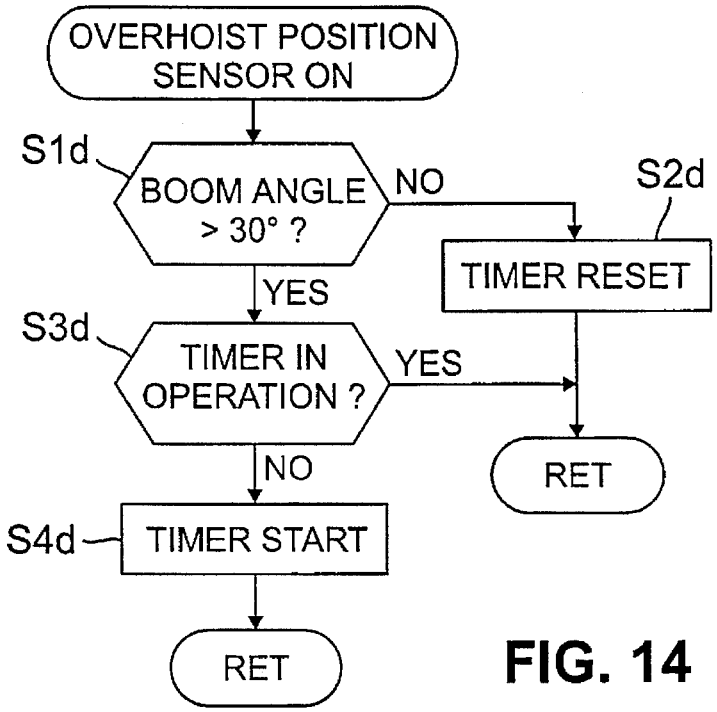
Figure 15:
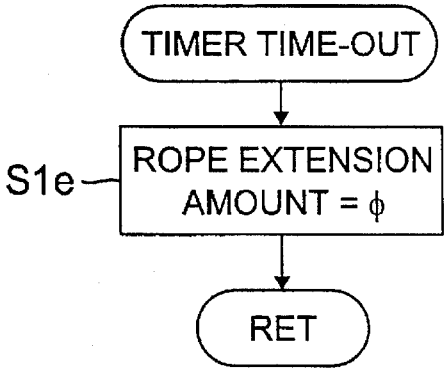
Figure 16:
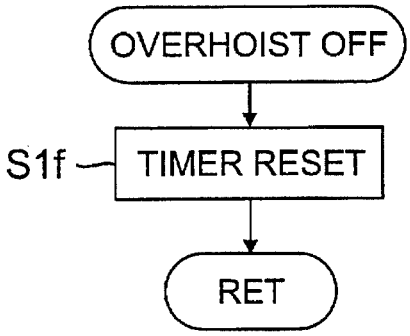

When the hook structure reaches the overhoist position and the overhoist position sensor turns on, an interrupt routine shown in FIG. 14 starts running. At step $S_{1d}$, it is checked to see if the boom angle is 30° or more. If less than 30°, the timer is reset at step $S_{2d}$. If equal to or more than 30°, at step $S_{3d}$ it is checked to see if the timer is operating (if the timer is operating, then the overhoist position sensor was turned on and its process is being executed). If the timer is not operating, then the timer is caused to start at step $S_{4d}$. Upon time-out of the timer, at step $S_{1e}$ of FIG. 15, an interrupt routine forcibly resets to 0 the rope extension amount calculated by the process of FIG. 13. In this manner, the reference point for the rope extension amount is automatically modified. If the hook structure moves away from the overhoist position and the sensor turns off before time-out of the timer, the timer is reset by an interrupt routine as shown in FIG. 16 at step $S_{1f}$. Thus, only when the hook structure remains at the overhoist position during the predetermined time period is the reference point of the rope extension amount modified.

We claim:

1. A method for accurately determining lifting distances of a load hook on a crane with a frame, at least one extensible length boom mounted on said frame and adapted for movement between a plurality of angles in at least one vertical plane, a rope for hoisting and lowering a load attached to the hook, said hook being operatively connected to said rope and supportively suspended from said boom, winch means mounted on said frame for hoisting and lowering said rope and hook therewith, a CPU means, a key group for entering data in the CPU means, a screen means for graphically and numerically displaying operation modes of the crane, a plurality of crane operation parameter sensors mounted on the crane at predetermined positions for generating and transmitting signals representative of the boom length, angle, rope lengths and the hook positions to the CPU means, comprising the steps of:

a) setting the frame and boom of the crane in a first preselected operation state and entering the data representative of said state into the CPU means by the key group;

b) using the data from the first preselected operation state of the boom for establishing a first hook overhoist position below a selected portion of said boom;

c) using the first hook overhoist position for determining a hook lifting distance relative to a preselected datum located vertically below said first hook overhoist position;

d) generating signals by operation parameter sensors to indicate changes in the boom length and angle relative to said first preselected operation state, and transmitting the generated signals to the CPU means;

e) measuring the extension and retraction lengths of the rope when hoisting and lowering the hook;

f) determining the distance of the hook from the first overhoist position by calculating the accumulated extension and retraction lengths values of the rope with the CPU means and a rope movement parameter sensor;

g) resetting the accumulated rope extensions and retraction lengths to a zero (0) value in response to the load hook reaching said first overhoist position; and h) displaying graphically and numerically the boom length, boom angle and hook lifting distance between said preselected datum and said first hook overhoist position.

2. A method according to claim 1, wherein an overground height of the load hook at the first hook overhoist position is the maximum lifting distance at the first preselected operation state.

3. A method according to claim 1, wherein said resetting of the accumulated rope extensions and retraction lengths is conducted only when the load hook is at the first overhoist position longer than a predetermined time period.

* * * * *